US010471721B2

(12) United States Patent
Muraoka

(10) Patent No.: US 10,471,721 B2
(45) Date of Patent: Nov. 12, 2019

(54) INK-JET RECORDING APPARATUS

(71) Applicant: KYOCERA Document Solutions Inc., Osaka (JP)

(72) Inventor: Toshinori Muraoka, Osaka (JP)

(73) Assignee: KYOCERA Document Solutions Inc., Osaka (JP)

( * ) Notice: Subject to any disclaimer, the term of this patent is extended or adjusted under 35 U.S.C. 154(b) by 0 days.

(21) Appl. No.: 16/053,063

(22) Filed: Aug. 2, 2018

(65) Prior Publication Data

US 2019/0061357 A1 Feb. 28, 2019

(30) Foreign Application Priority Data

Aug. 23, 2017 (JP) ..... 2017-159988

(51) Int. Cl.
*B41J 2/165* (2006.01)
*B41J 2/155* (2006.01)
*B41J 11/00* (2006.01)

(52) U.S. Cl.
CPC ..... *B41J 2/16544* (2013.01); *B41J 2/155* (2013.01); *B41J 2/16508* (2013.01); *B41J 2/16538* (2013.01); *B41J 2/16547* (2013.01); *B41J 2/16585* (2013.01); *B41J 11/005* (2013.01); *B41J 11/006* (2013.01); *B41J 2202/20* (2013.01); *B41J 2202/21* (2013.01)

(58) Field of Classification Search
USPC ..... 347/33
See application file for complete search history.

(56) References Cited

U.S. PATENT DOCUMENTS 5,231,423 A * 7/1993 Wataya ..... B41J 2/04515 165/104.33
6,592,200 B2 * 7/2003 Wotton ..... B41J 2/16547 347/22
7,530,666 B2 * 5/2009 Akahira ..... B41J 2/14016 347/13
8,025,356 B2 * 9/2011 Habashi ..... B41J 2/16585 347/19
2005/0068365 A1 * 3/2005 Takagi ..... B41J 2/16538 347/33

FOREIGN PATENT DOCUMENTS

JP H 07-40540 A 2/1995

* cited by examiner

*Primary Examiner* — Lam S Nguyen
(74) *Attorney, Agent, or Firm* — Stein IP, LLC

(57) ABSTRACT

An ink-jet recording apparatus includes a plurality of recording heads, a wipe unit, and an entry prevention member. The wipe unit includes a wiper for wiping an ink ejection face in a predetermined direction. The entry prevention member is arranged between the recording heads in a sheet conveying direction to prevent the recording medium from entering the gaps between the recording heads. The entry prevention member is configured to be movable in an up-down direction, is arranged in an entry prevention position where its lower face is flush with, or projects below, the ink ejection face during printing operation, and is arranged in a retracted position where the lower face is retracted above the ink ejection face during wiping operation by the wipe unit.

6 Claims, 13 Drawing Sheets

INK-JET RECORDING APPARATUS

INCORPORATION BY REFERENCE

This application is based upon and claims the benefit of priority from the corresponding Japanese Patent Application No. 2017-159988 filed on Aug. 23, 2017, the entire contents of which are incorporated by reference.

BACKGROUND

The present disclosure relates to an ink-jet recording apparatus provided with a recording head for ejecting ink onto a recording medium such as a sheet, and a wipe unit with a wiper for wiping off an ink ejection face on the recording head.

As recording apparatuses such as facsimile machines, copiers, and printers, ink-jet recording apparatuses, which form images by ejecting ink, are widely used for their ability to form high-definition images.

In conventional ink-jet recording apparatuses, to prevent dehydration and clogging in ejection nozzles on the recording head, the recording head is typically capped when printing is not performed for a long period of time. Also, recovering operation is generally performed, where the thickened ink inside the ejection nozzles is forcibly pushed out of the ejection nozzles to be wiped off by a wiper. Thus, ink-jet printing apparatuses are provided with a recording head for ejecting ink onto a recording medium, a cap unit for capping the recording head, and a wipe unit for performing recovery operation for the recording head.

The wiper in the wipe unit is formed to have a width larger than that of the ink ejection face so as not to leave any unwiped area on the ink ejection face on the recording head. If the wiper touches the ink ejection face on the adjacent recording head, the ink ejection face becomes soiled. A plurality of recording heads are thus arranged at predetermined intervals in the direction perpendicular to the wiping direction.

SUMMARY

According to one aspect of the present disclosure, an ink-jet recording apparatus includes a plurality of recording heads, a wipe unit, and an entry prevention member. The recording heads include ink ejection faces in which ejection nozzles for ejecting ink onto a recording medium are open. The wipe unit can reciprocate between a first position right below the recording heads and a second position horizontally retracted from the first position, and has a wiper for performing wiping operation, by which the ink ejection face is wiped in a predetermined direction in the first position. The entry prevention member is arranged between the recording heads in the recording medium conveying direction, preventing the recording medium to enter the gap between the recording heads. The entry prevention member is configured to be movable in an up-down direction, is arranged in an entry prevention position where its lower face is flush with the ink ejection face, or projects below the ink ejection face, during printing operation, and is arranged in a retracted position where the lower face is retracted above the ink ejection face during wiping operation by the wipe unit.

This and other objects of the present disclosure, and the specific benefits obtained according to the present disclosure, will become apparent from the description of embodiments which follows.

DETAILED DESCRIPTION

Hereinafter, embodiments of the present disclosure will be described with reference to the accompanying drawings.

Figure 1:
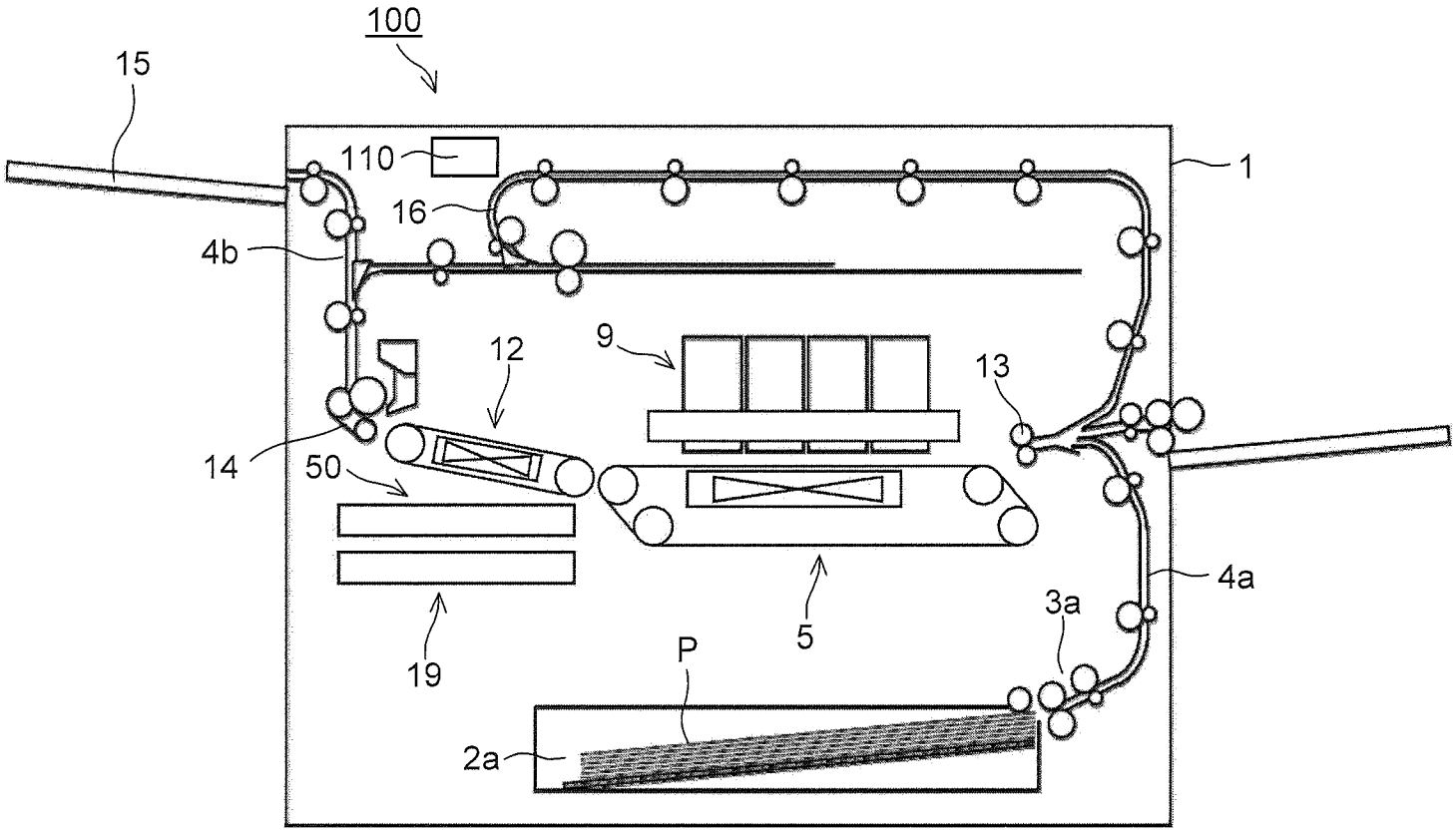
FIG. 1 is a diagram showing an outline of a structure of a printer according to one embodiment of the present disclosure.

With reference to FIG. 1 to FIG. 25, an ink-jet printer 100 (ink-jet recording apparatus) according to one embodiment of the present disclosure will be described. As shown in FIG. 1, the printer 100 has a sheet feed cassette 2*a* as a sheet storage portion arranged in a lower part inside a printer main body 1. Inside the sheet feed cassette 2*a*, sheets P as one example of a recording medium are stored. On the downstream side of the sheet feed cassette 2*a* in the sheet conveying direction, that is, to the upper right of the sheet feed cassette 2*a* in FIG. 1, a sheet feeding device 3*a* is arranged. By the sheet feeding device 3*a*, sheets P are fed out one after another separately to the upper right of the sheet feed cassette 2*a* in FIG. 1.

The printer 100 is provided with a first sheet transport passage 4*a* inside. The first sheet transport passage 4*a* is located to the upper right with respect to the sheet feed cassette 2*a*, that is, in the sheet feed direction. Sheets P fed out of the sheet feeding cassette 2*a* are conveyed vertically upward along a side face of the printer main body 1 via the first sheet transport passage 4*a*.

At the downstream end of the first sheet conveying passage 4*a* in the sheet conveying direction, a registration roller pair 13 is provided. Close to a downstream-side part of the registration roller pair 13 in the sheet conveying direction, a first conveying unit 5 and a recording portion 9 are arranged. Sheets P fed out of the sheet feed cassette 2*a* reaches the registration roller pair 13 via the first sheet transport passage 4*a*. The registration roller pair 13, while correcting skewed conveying of sheets P and coordinating with the timing of ink ejecting operation by the recording portion 9, feeds out the sheets P toward the first conveying unit 5.

On the downstream side (left side in FIG. 1) of the first conveying unit 5 in the sheet conveying direction, a second conveying unit 12 is arranged. A sheet P having an ink image recorded on it at the recording portion 9 is conveyed to the second conveying unit 12. While the sheet P passes through the second conveying unit 12, the ink ejected on the surface of the sheet P is dried.

On the downstream side of the second conveying unit 12 in the sheet conveying direction, near the left side face of the printer main body 1, a decurler portion 14 is provided. The sheet P with the ink dried at the second conveying unit 12 is conveyed to the decurler portion 14 so that the curled sheet P is straightened.

On the downstream side (in an upper part in FIG. 1) of the decurler portion 14 in the sheet conveying direction, a second sheet conveying passage 4*b* is provided. The sheet P that has passed through the decurler portion 14 is, when no double-sided recording is performed, discharged from the second sheet conveying passage 4*b* to a sheet discharge tray 15 provided outside the left side face of the printer 100.

In an upper part of the printer main body 1, over the recording portion 9 and the second conveying unit 12, an reversing conveying passage 16 for double-sided recording is provided. When double-sided recording is performed, the sheet P having recording on its first side completed and having passed through the second unit 12 and the decurler portion 14 is conveyed via the second sheet conveying passage 4*b* to the reversing conveying passage 16. The sheet P conveyed to the reversing conveying passage 16 has its conveying direction switched for recording on the second side, is conveyed rightward through the upper part of the printer main body 1, and is conveyed, via the first sheet conveying passage 4*a* and the registration roller pair 13, with the second face up, once again to the first conveying unit 5.

Under the second conveying unit 12, a wipe unit 19 and a cap unit 50 are arranged. The wipe unit 19, when it performs purging as will be described later, horizontally moves to under the recording portion 9, where it wipes off the ink pushed out of ejection nozzles in a recording head and collects the wiped-off ink. The cap unit 50, when it caps the ink ejection face of the recording head, horizontally moves to under the recording portion 9 and then moves upward to be attached to the bottom face of the recording head.

Figure 2:
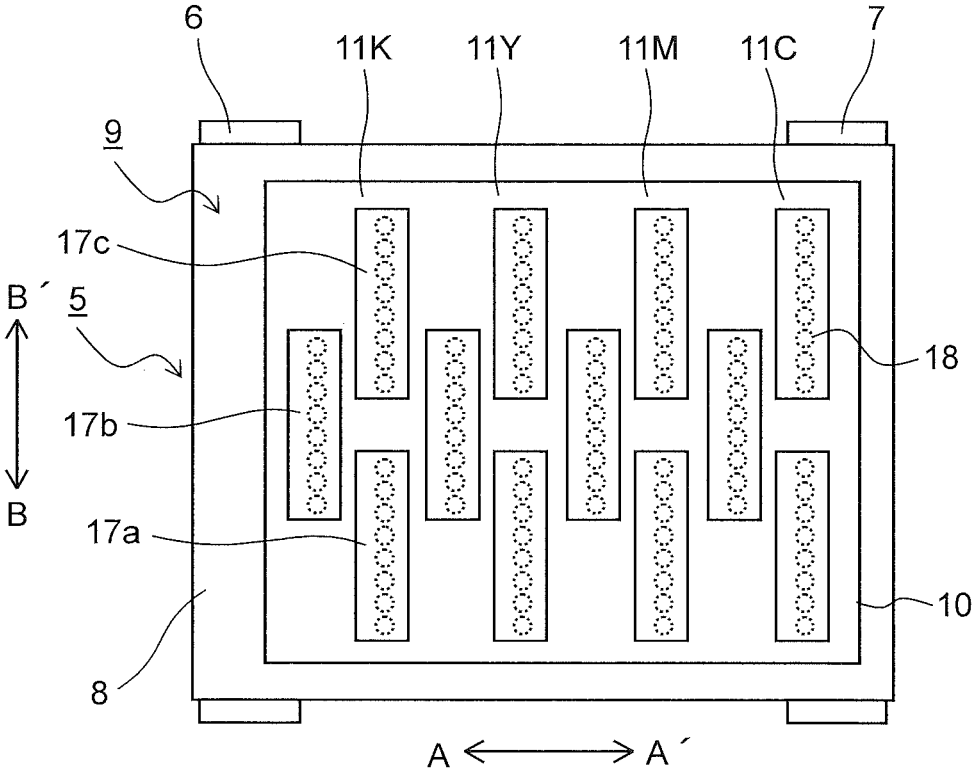
FIG. 2 is a diagram showing a first conveying unit and a recording portion in the printer according to the one embodiment of the present disclosure, as seen from above.
Figure 3:
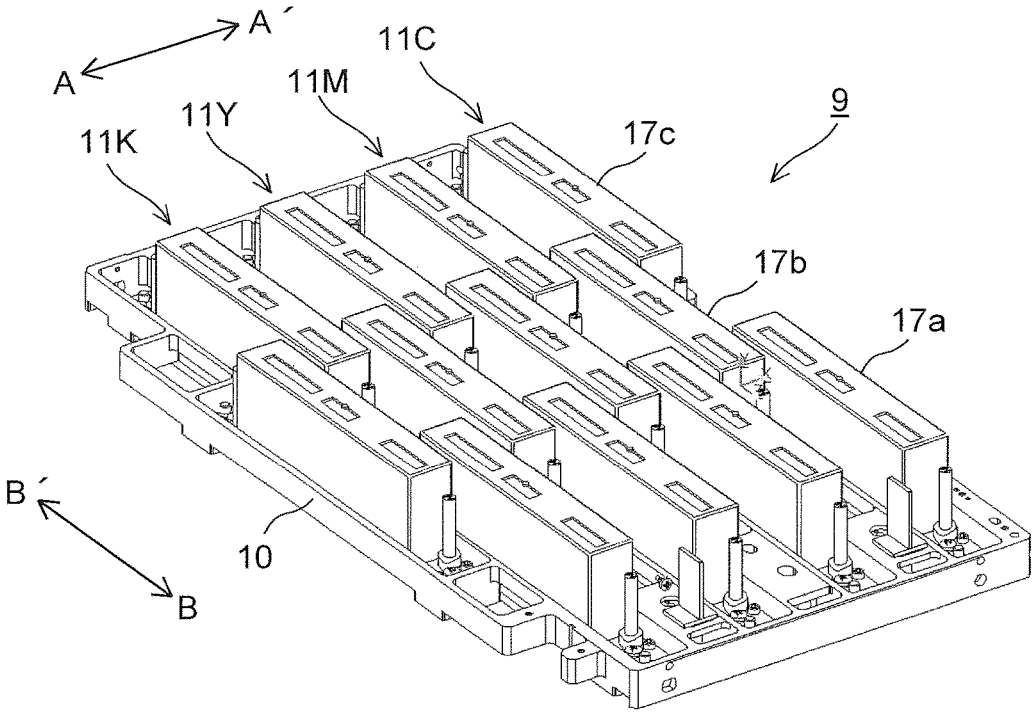
FIG. 3 is a diagram showing a structure of the recording portion in the printer according to one embodiment of the present disclosure.

The recording portion 9 includes, as shown in FIGS. 2 and 3, a head housing 10, and line heads 11C, 11M, 11Y and 11K held on the head housing 10. These line heads 11C to 11K are held at such a height that a predetermined gap (i.e. 1 mm) is formed relative to the conveying face of a first conveying belt 8, which is stretched around a plurality of rollers including a driving roller 6 and a driven roller 7, and along the sheet width direction (arrow BB' direction), which is perpendicular to the sheet conveying direction (arrow A direction), a plurality of (here, three) recording heads 17*a* to 17*c* are arrayed in a staggered manner.

Figure 4:
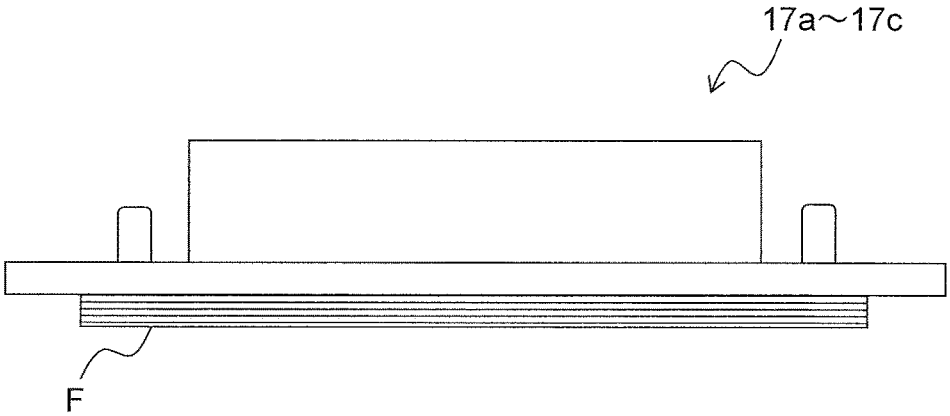
FIG. 4 is a diagram showing a structure of recording heads constituting line heads of the recording portion in the printer according to one embodiment of the present disclosure.
Figure 5:
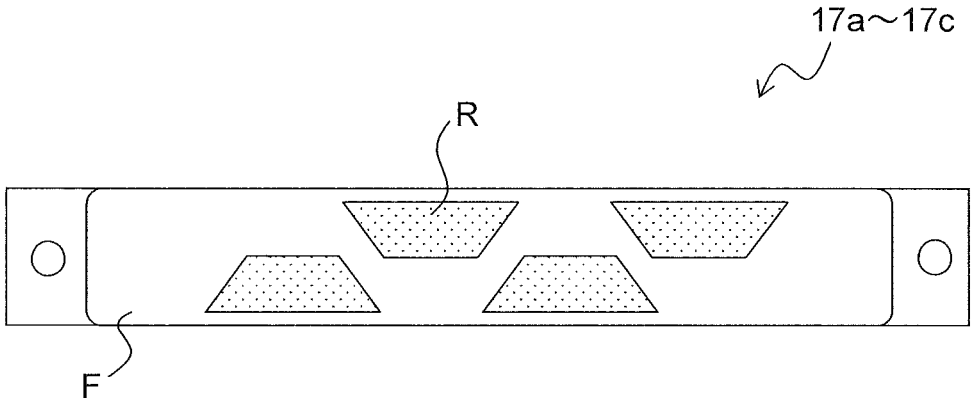
FIG. 5 is a diagram showing the recording head in the printer according to one embodiment of the present disclosure, as seen from an ink ejection face side.

As shown in FIGS. 4 and 5, at the ink ejection face F on the recording heads 17*a* to 17*c*, there is provided a nozzle region R in which a large number of ejection nozzles 18 (see FIG. 2) are arrayed. Since the recording heads 17*a* to 17*c* have the same shape and structure, FIGS. 4 and 5 each show only one of the recording heads 17*a* to 17*c*.

To the recording heads 17*a* to 17*c* constituting the line heads 11C to 11K, ink of four colors (cyan, magenta, yellow, and black) stored in ink tanks (unillustrated) is supplied, ink of different colors being supplied to corresponding one of the line heads 11C to 11K respectively.

According to a control signal from a control portion 110 (see FIG. 1), which controls the whole printer 100, and based on image data received from an external computer or the like, the recording heads 17*a* to 17*c* eject ink from the ejection nozzles 18 toward the sheet P, which is conveyed while being held by absorption on the conveying face of the first conveying belt 8. With this, on the sheet P on the first conveying belt 8, there is formed a color image having ink of four colors, namely cyan, magenta, yellow, and black, overlaid together.

In order to prevent ink ejection failure due to dehydration or clogging in the recording heads 17*a* to 17*c*, purging is performed by pushing ink with high viscosity in the nozzles out of, at the start of printing after a long out-of-operation period, all the ejection nozzles 18 in the recording heads 17*a* to 17*c*, or, during intermissions of printing, ejection nozzles 18 with a lower ink ejection amount than a prescribed value, in preparation for subsequent printing operation.

Next, the cap unit 50, the wipe unit 19, and the structure around them will be described in detail.

Figure 6:
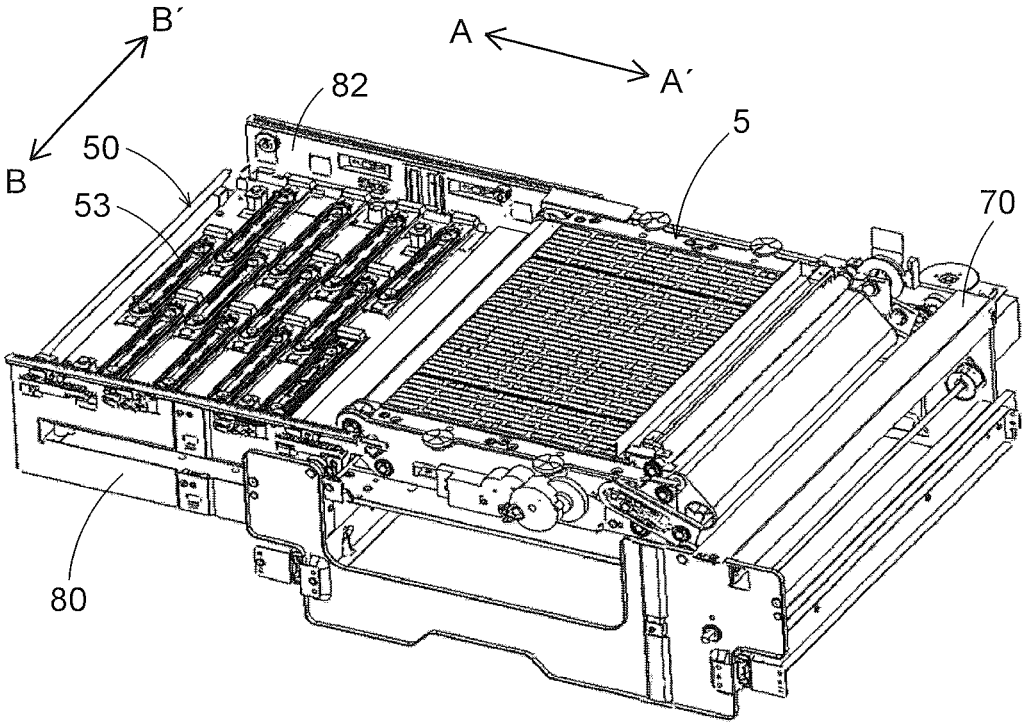
FIG. 6 is a diagram showing a structure of a cap unit, the first conveying unit, and the like in the printer according to one embodiment of the present disclosure in a state where the first conveying unit is arranged in an ascended position.
Figure 7:
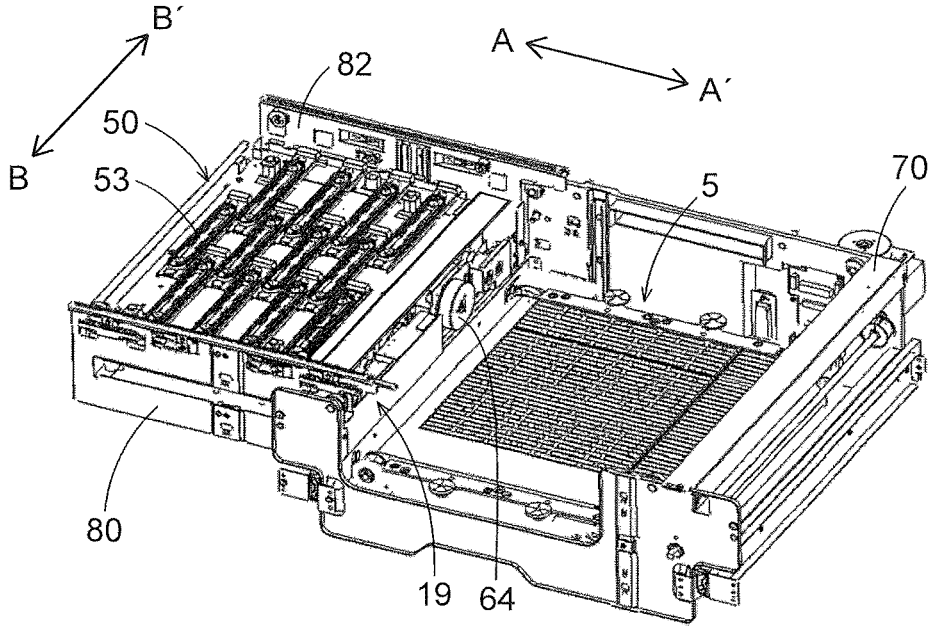
FIG. 7 is a diagram showing a structure of the cap unit, the first conveying unit, and the like in the printer according to one embodiment of the present disclosure in a state where the first conveying unit is arranged in a descended position.

The first conveying unit 5 is, as shown in FIGS. 6 and 7, housed in a housing frame 70. The first conveying unit 5 is configured to be ascendable/descendable in the up-down direction by the action of a conveying lift mechanism (unillustrated) comprising a lifting driving source, a gear train, and the like. The first conveying unit 5 is, during printing operation, arranged in an ascended position (the position in FIG. 6) so as to be close to the ink ejection face F on the recording heads 17*a* to 17*c*. The first conveying unit 5 is, during recovering and capping operation of the recording heads 17*a* to 17*c*, which will be described later, arranged in a descended position (the position in FIG. 7).

Figure 8:
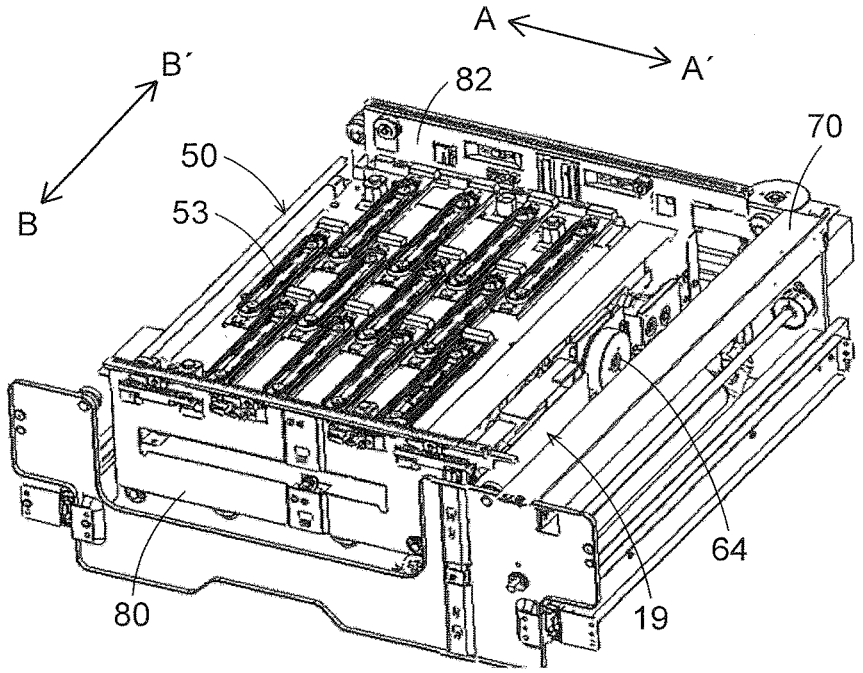
FIG. 8 is a diagram showing a structure of the cap unit, and the like in the printer according to one embodiment of the present disclosure in a state where the cap unit and a wipe unit are arranged in a first position.
Figure 9:
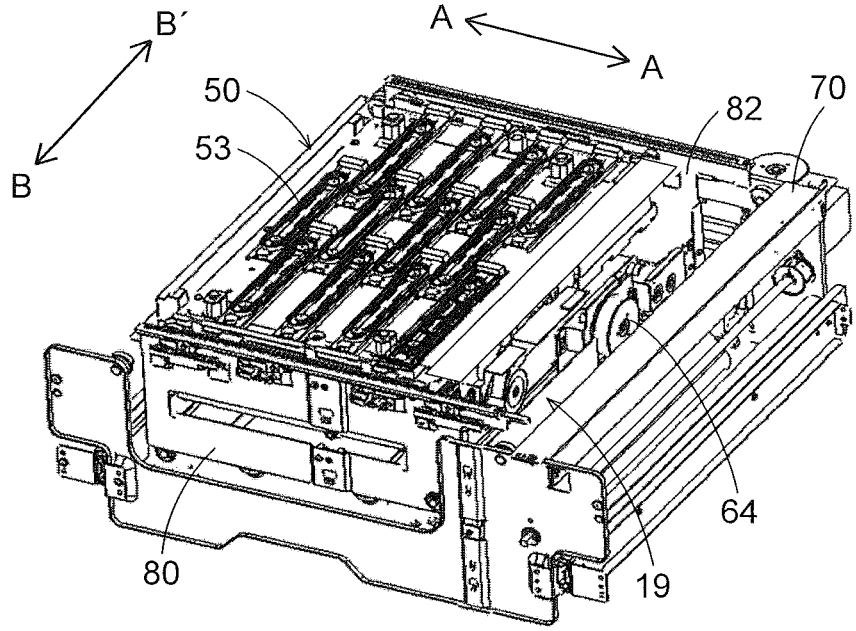
FIG. 9 is a diagram showing a state where the cap unit and the wipe unit are ascended from the state in FIG. 8.

The cap unit 50 is, as shown in FIGS. 7 and 8, configured to be reciprocatable between a first position (the position in FIG. 8) right below the recording portion 9 and a second position (the position in FIG. 7) retracted from the first position in the horizontal direction (arrow A direction). When the cap unit 50 is arranged in the first position, the first conveying unit 5 is arranged in the descended position. The cap unit 50 is, as shown in FIGS. 8 and 9, configured to be ascendable/descendable in the up-down direction in the first position.

The cap unit 50 is, during printing and recovering operation, arranged in the second position (position in FIG. 6). The cap unit 50 is, during capping operation, configured to move up in the first position (the position in FIGS. 8 and 9) to cap the recording heads 17*a* to 17*c*. The cap unit 50 is, as will be described later, configured to be couplable/decouplable to and from the wipe unit 19 in the second position, and the cap unit 50 can move horizontally and in the up-down direction as a result of the wipe unit 19 moving in a state coupled to the cap unit 50.

Figure 10:
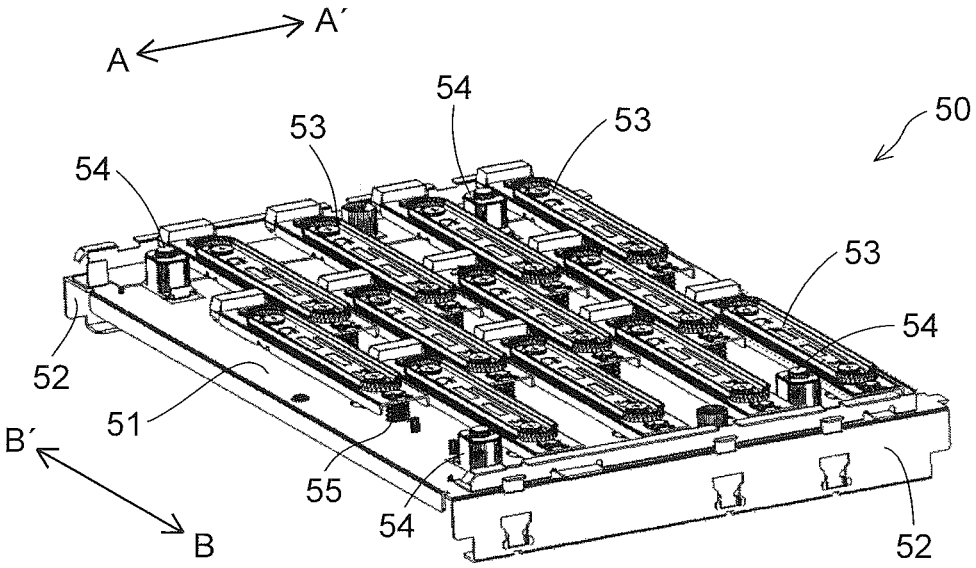
FIG. 10 is a diagram showing the structure of the cap unit in the printer according to one embodiment of the present disclosure.

The cap unit 50 includes, as shown in FIG. 10, a cap tray 51 made of sheet metal, a pair of tray side plates 52 formed at both ends of the cap tray 51 in the sheet width direction (arrow BB' direction), twelve cap portions 53, each on the form of a recess, arranged on the top face of the cap tray 51, and four height-direction positioning projections 54.

The cap portions 53 are arranged in the positions corresponding to the recording heads 17*a* to 17*c*. With this, as shown in FIG. 9, when the cap unit 50 moves up in the first position, the cap portions 53 cap the ink ejection face F on the recording heads 17*a* to 17*c*. The height-direction positioning projections 54, when the cap unit 50 is moved up toward the recording portion 9 to cap the recording heads 17*a* to 17*c*, touch the housing 10 of the recording portion 9, and thereby position the cap tray 51 in the height direction. Between bottom parts of both ends of the cap potions 53 in their longitudinal direction (arrow BB' direction) and the cap tray 51, cap springs 55 comprising compressed springs are arranged. The cap springs 55 serve to keep constant the state of contact between the cap portions 53 and the ink ejection face F.

Figure 11:
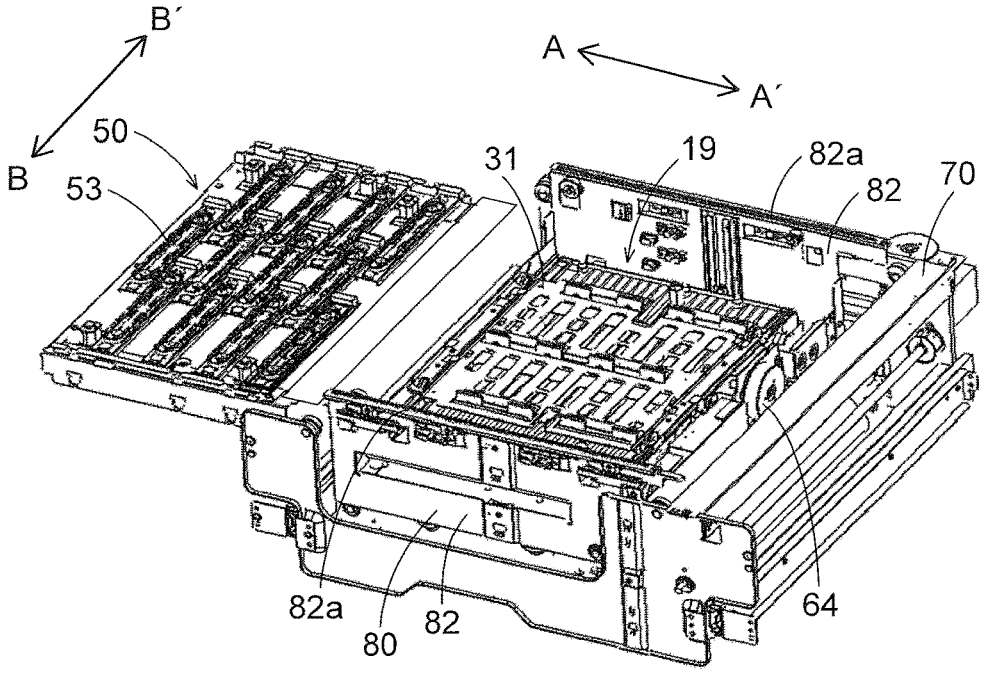
FIG. 11 is a diagram showing a structure of the cap unit, the wipe unit, and the like in the printer according to one embodiment of the present disclosure in a state where the cap unit is arranged in a second position and the wipe unit is arranged in the first position.

The wipe unit 19 is, as shown in FIGS. 7 and 11, configured to be reciprocatable between a first position (the position in FIG. 11) right below the recording portion 9 and a second position (the position in FIG. 7) retracted from the first position in the horizontal direction (arrow A direction). When the wipe unit 19 is arranged in the first position, the first conveying unit 5 is arranged in the descended position. The wipe unit 19 is, as shown in FIGS. 11 and 12, configured to be ascendable/descendable in the up-down direction in the first position.

The wipe unit 19 is, during printing operation, arranged in the second position. The wipe unit 19 is configured such that, during recovering and capping operation, it moves up in the first position (position in FIG. 11).

Figure 12:
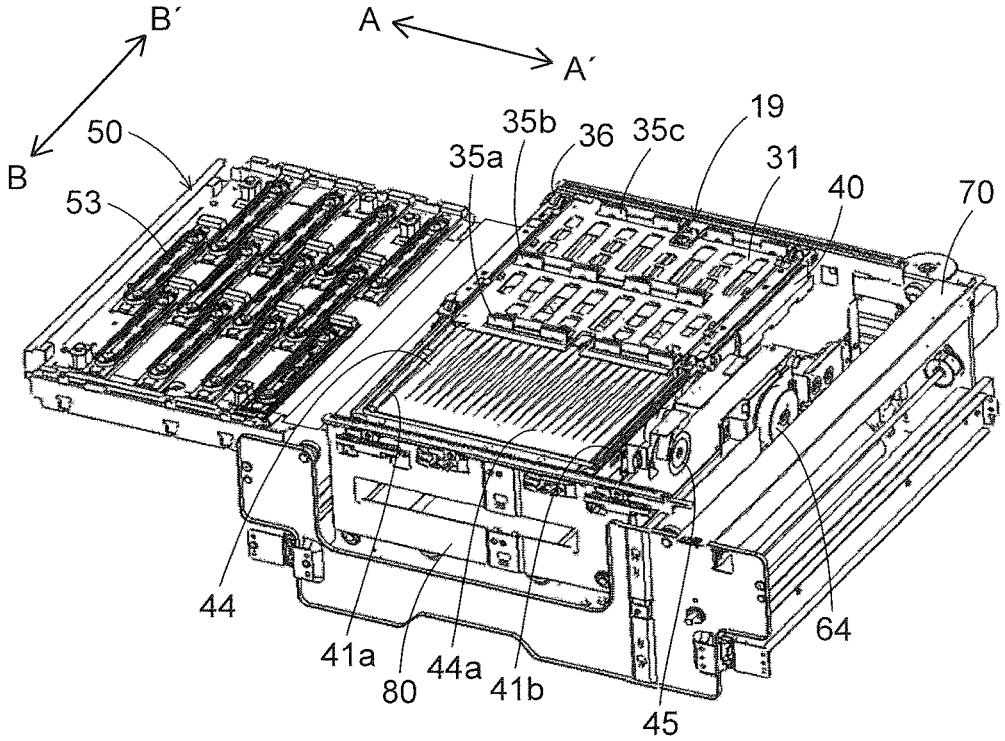
FIG. 12 is a diagram showing a state where the wipe unit is ascended from the state in FIG. 11.
Figure 13:
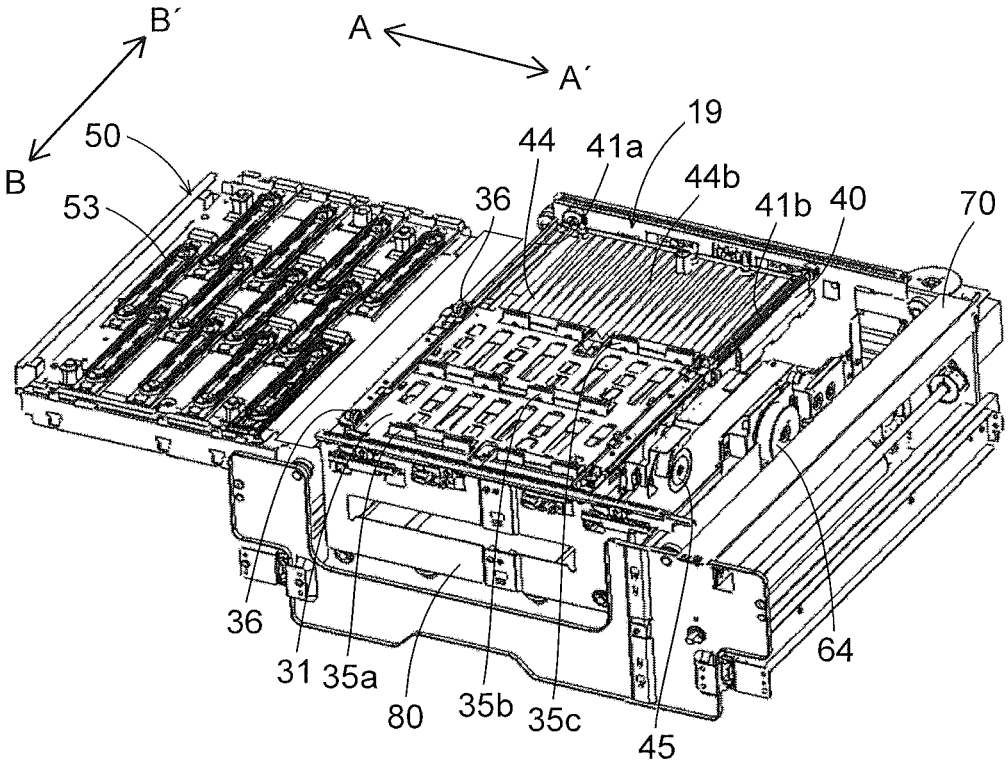
FIG. 13 is a diagram showing a state where a wiper carriage is moved from the state in FIG. 12 in an arrow B direction.

The wipe unit 19 includes, as shown in FIGS. 12 and 13, a substantially rectangular wiper carriage 31 to which a plurality of wipers 35*a* to 35*c* are fixed, and a supporting frame 40 on which the wiper carriage 31 is supported.

On the edges of the top face of the supporting frame 40 facing away from each other in the arrow AA' direction, rail portions 41*a* and 41*b* are formed. Rollers 36 provided in the four corners of the wiper carriage 31 touch the rail portion 41*a* and 41*b*, and thereby the wiper carriage 31 are supported slidably in the arrow BB' direction relative to the supporting frame 40.

Outside the supporting frame 40, there are fitted a wiper carriage moving motor 45 for moving the wiper carriage 31 in the horizontal direction (arrow BB' direction), and a gear train (unillustrated) that meshes with the wiper carriage moving motor 45 and with the rack teeth (unillustrated) on the wiper carriage 31. As the wiper carriage moving motor 45 rotates forward and backward, the gear train rotates forward and backward, and thus the wiper carriage 31 reciprocates in the horizontal direction (arrow BB' direction).

The wipers 35*a* to 35*c* are elastic members (for example, rubber members made of EPDM) for wiping the ink pushed out of the ejection nozzles 18 of the recording heads 17*a* to 17*c*. The wipers 35*a* to 35*c* are each formed to have a width larger than that of the ink ejection face F (length in arrow AA') so as not to leave any unwiped area on the ink ejection face F. The wipers 35*a* to 35*c* are pressed substantially from the vertical direction to remain contact with a wiping start position outside the nozzle region R (see FIG. 5) where the nozzle face of the ejection nozzles 18 are exposed, and as the wiper carriage 31 moves, wipe the ink ejection face F including the nozzle region R in a predetermined direction (arrow B direction in FIG. 12).

Four wipers 35*a* are arranged substantially at equal intervals, and similarly, four wipers 35*b* and four wipers 35*c* are arranged substantially at equal intervals. The wipers 35*a* and 35*c* are arranged at positions corresponding to the recording heads 17*a* and 17*c* (see FIG. 3) constituting the line heads 11C to 11K. The wipers 35*b* are arranged at a position corresponding to the recording heads 17*b* (see FIG. 3) constituting the line heads 11C to 11K and are fixed at positions shifted by a predetermined distance relative to the wipers 35*a* and 35*c* in a direction (arrow AA' direction) perpendicular to the moving direction of the wiper carriage 31.

On the top face of the supporting frame 40, there is arranged an ink collection tray 44 for collecting the waste ink wiped off the ink ejection face F by the wipers 35*a* to 35*c*. Substantially in a central part of the ink collection tray 44, an ink drainage hole (unillustrated) is formed, and tray faces 44*a* and 44*b* on both sides of the ink drainage hole slope down toward the ink drainage hole. The waste ink wiped off the ink ejection face F by the wipers 35*a* to 35*c* drops on the tray faces 44*a* and 44*b* and flows toward the ink drainage hole (unillustrated). The ink is then, via an ink collection passage (unillustrated) coupled to the ink drainage hole, collected in a waste ink collection tank (unillustrated).

The wipe unit 19 is, as shown in FIG. 7, housed in a carriage 80 which has a U-shaped cross section, and is, in the second position, arranged under the cap unit 50. As shown in FIGS. 7 and 11, when moving in the horizontal direction (arrow AA' direction), the wipe unit 19 moves together with the carriage 80, and as shown in FIGS. 11 and 12, when moving in the up-down direction, the wipe unit 19 moves in the up-down direction relative to the carriage 80.

Figure 14:
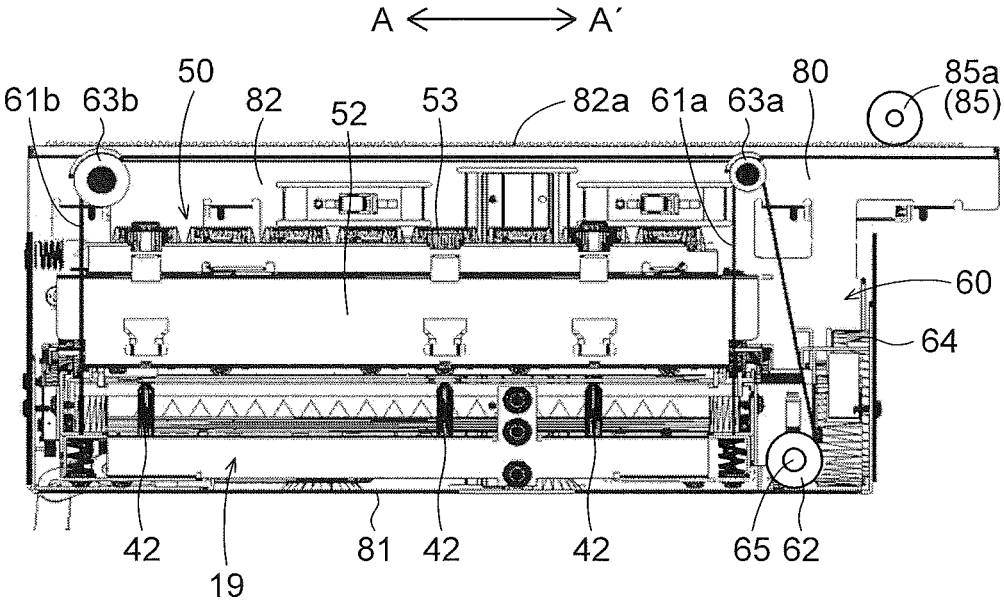
FIG. 14 is a diagram showing a structure of and around a unit lift mechanism in the printer according to one embodiment of the present disclosure.

The carriage 80 includes a carriage bottom plate 81 (see FIG. 14) made of sheet metal on which the wipe unit 19 is placed and a pair of carriage side plates 82 arranged upright along both ends of the carriage bottom plate 81 in the sheet width direction (arrow BB' direction). The carriage side plates 82 are configured so as to be slidable relative to carriage support rails (unillustrated) in the printer main body 1. On the top face of the carriage side plate 82, as shown in FIG. 14, a rack potion 82*a* having rack teeth is formed. The rack portion 82*a* is meshed with a gear 85*a*, and the gear train including the gear 85*a* is connected to a carriage driving source (unillustrated) comprising a motor. As the carriage driving source rotates forward and backward, the gear train rotates forward and backward, and thus the carriage 80 reciprocates between a first position and a second position. The gear train including the gear 85*a* and the carriage driving source constitute a unit horizontal-movement mechanism 85 which moves the cap unit 50 and the wipe unit 19 in the horizontal direction.

Inside the carriage 80, as shown in FIG. 14, there is provided a unit lift mechanism 60 to ascend/descend the wipe unit 19 in the up-down direction. The unit lift mechanism 60 includes wires 61*a* and 61*b*, a wind-up pulley 62 for winding up the wires 61*a* and 61*b*, pulleys 63*a* and 63*b* for changing the direction of the wires 61*a* and 61*b*, and a wind-up drive moto (wind-up driving source) 64.

The wire 61*a*, extending from the wind-up pulley 62 via the pulley 63*a*, is attached to a lower part of the wipe unit 19 in the arrow A' direction. The wire 61*b*, extending from the wind-up pulley 62 via the pulleys 63*a* and 63*b*, is attached to a lower part of the wipe unit 19 in the arrow A direction. The wires 61*a* and 61*b*, the wind-up pulley 62, and the pulley 63*a* and 63*b* are provided one of each on either side in the arrow BB' direction (on each of the front and back sides of the plane of FIG. 14). A pair of wind-up pulleys 62 is fixed at opposite ends of a rotary shaft 65. To the rotary shaft 65, a rotary shaft gear (unillustrated) engaged with a gear train (unillustrated) connected to the wind-up drive motor 64 is fixed. As the wind-up drive motor 64 rotates forward and backward, the wind-up pulley 62 rotates forward and backward.

Figure 15:
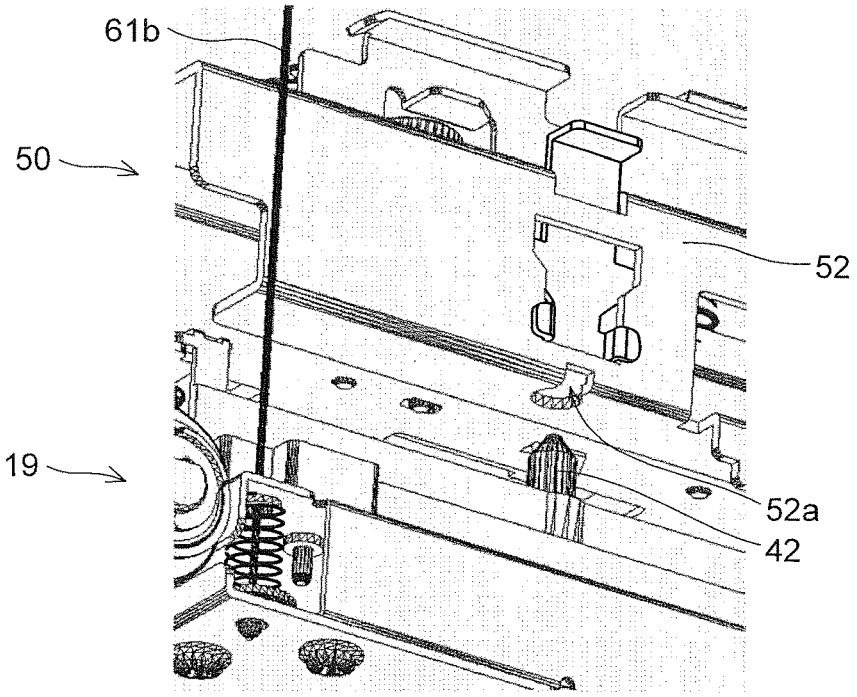
FIG. 15 is a diagram showing a structure of and around a coupling pin and a push-up piece in the printer according to one embodiment of the present disclosure in a state where the wipe unit and the cap unit are not connected with each other.

As shown in FIGS. 14 and 15, in the wipe unit 19, there are provided a plurality of coupling pins 42 extending upward. On the bottom face of the tray side plate 52 in the cap unit 50, there are formed coupling holes 52*a* (see FIG. 15) at positions corresponding to the coupling pins 42. The coupling pins 42 and the coupling holes 52*a* constitute a coupling mechanism which couples and decouples the cap unit 50 and the wipe unit 19 to and from each other.

Figure 16:
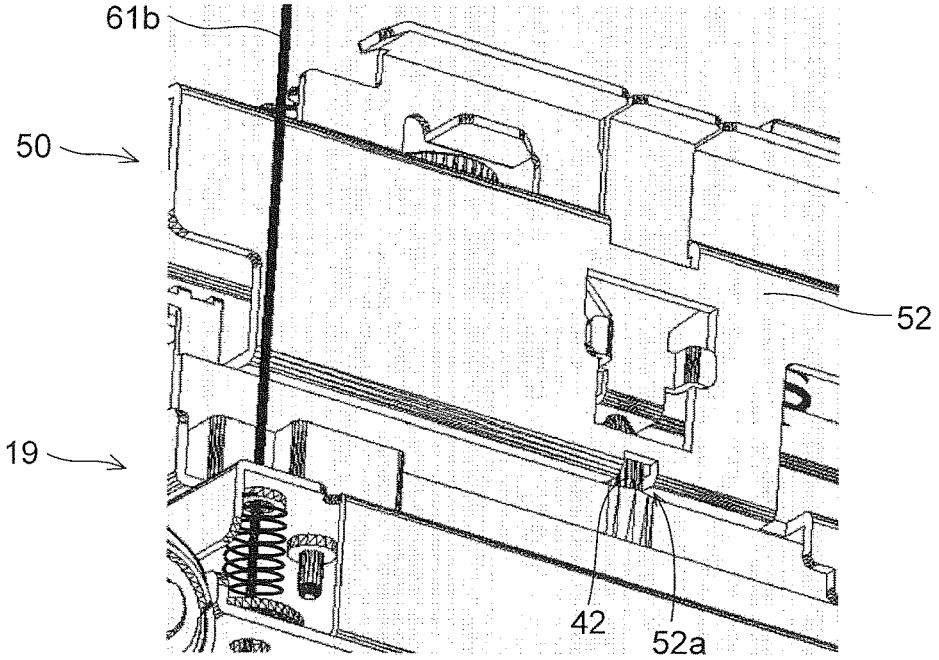
FIG. 16 is a diagram showing a structure of and around the coupling pin and the push-up piece in the printer according to one embodiment of the present disclosure in a state where the wipe unit and the cap unit are connected with each other.

When the wipe unit 19 is descended in the second position (the state in FIG. 14, the state arranged in a first height position), as shown in FIG. 15, the coupling pins 42 are not inserted in the coupling holes 52*a* and thus the wipe unit 19 and the cap unit 50 are not coupled with each other (decoupled from each other). On the other hand, when the wipe unit 19 is ascended in the second position (arranged in a second height position which is higher than the first height position), as shown in FIG. 16, the coupling pins 42 are inserted into the coupling holes 52*a* and thus the wipe unit 19 and the cap unit 50 are coupled with each other. With this, the cap unit 50 is unified with the wipe unit 19 and becomes movable in the horizontal and up-down directions.

In the second position, there is provided a cap supporting portion (unillustrated) for supporting the cap unit 50 while the wipe unit 19 and the cap unit 50 in a state not coupled with each other (in a decoupled state). In the second position, there is also provided a lid member (unillustrated) for protecting the cap portion 53 by making a close contact with the cap portion 53 in the cap unit 50 with the wipe unit 19 and the cap unit 50 in a state not coupled with each other (except during capping operation (during printing and recovering operation)). The lid member (unillustrated) makes close contact with the cap portion 53 from above to prevent foreign matter such as dust, paper powder or the like from sticking to the top face (face making close contact with the ink ejection face F) in the cap portion 53, and restrain moisture inside the cap portion 53 from drying up by evaporating.

Next, the structure around the recording heads 17*a* to 17*c* will be described in detail.

Figure 17:
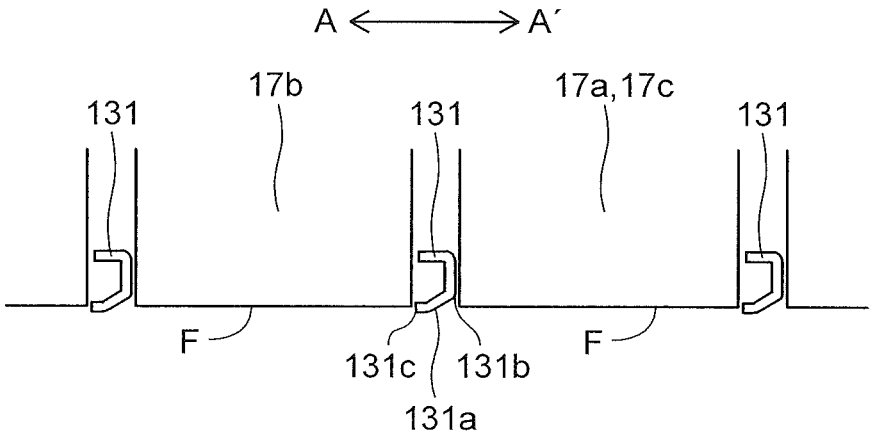
FIG. 17 is a diagram showing a structure of the recording heads and entry prevention members in the printer according to one embodiment of the present disclosure as seen from a sheet width direction in a state where the entry prevention member is arranged in an entry prevention position.
Figure 18:
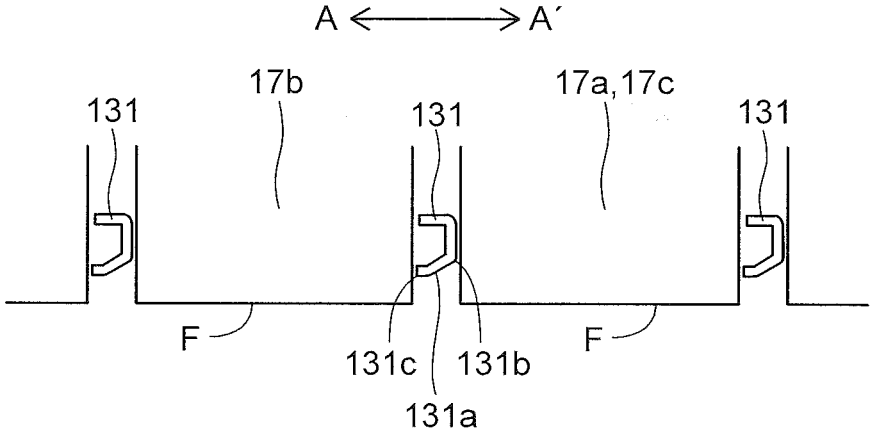
FIG. 18 is a diagram showing a structure of the recording heads and the entry prevention members in the printer according to one embodiment of the present disclosure as seen from the sheet width direction in a state where the entry prevention member is arranged in a retracted position.

As shown in FIGS. 2 and 3, the recording heads 17*a* and 17*c* and the recording head 17*b* are arranged at predetermined intervals in the sheet conveying direction (arrow A direction) which is perpendicular to a wiping direction (the direction in which the ink is wiped off by the wipers 35*a* to 35*c*). As shown in FIGS. 17 and 18, between the recording heads 17*a* and 17*c* and the recording head 17*b* in the sheet conveying direction, there are arranged entry prevention members 131 for preventing the leading edge of the sheet P from entering the gaps between the recording heads 17*a* and 17*c* and the recording head 17*b*.

The entry prevention member 131 is configured so as to be movable in the up-down direction. The entry prevention member 131 is, during printing operation, arranged in an entry prevention position (position in FIG. 17) where its lower face 131*a* is flush with the ink ejection face F or projects below the ink ejection face F, and during wiping operation by the wipe unit 19, arranged in a retracted position (position in FIG. 18) where the lower face 131*a* is retracted above the ink ejection face F. For example, the entry prevention member 131 is, during printing operation, arranged so that the lower face 131*a* projects below the ink ejection face F by 0.4 mm, and during wiping operation, arranged so that the lower face 131*a* is located above the ink ejection face F by 1 mm or more (in this example, about 2.2 mm).

The lower face 131*a* in the entry prevention member 131 is formed so as to be inclined downward from the upstream side to the downstream side in the sheet conveying direction. The upstream end 131*b* of the lower face 131*a* in the sheet conveying direction is, with the entry prevention member 131 in a state arranged in the entry prevention position (position in FIG. 17), arranged above the ink ejection face F. The downstream end 131*c* of the lower face 131*a* in the sheet conveying direction is, with the entry prevention member 131 in a state arranged in the entry prevention position, arranged below the ink ejection face F.

Figure 19:
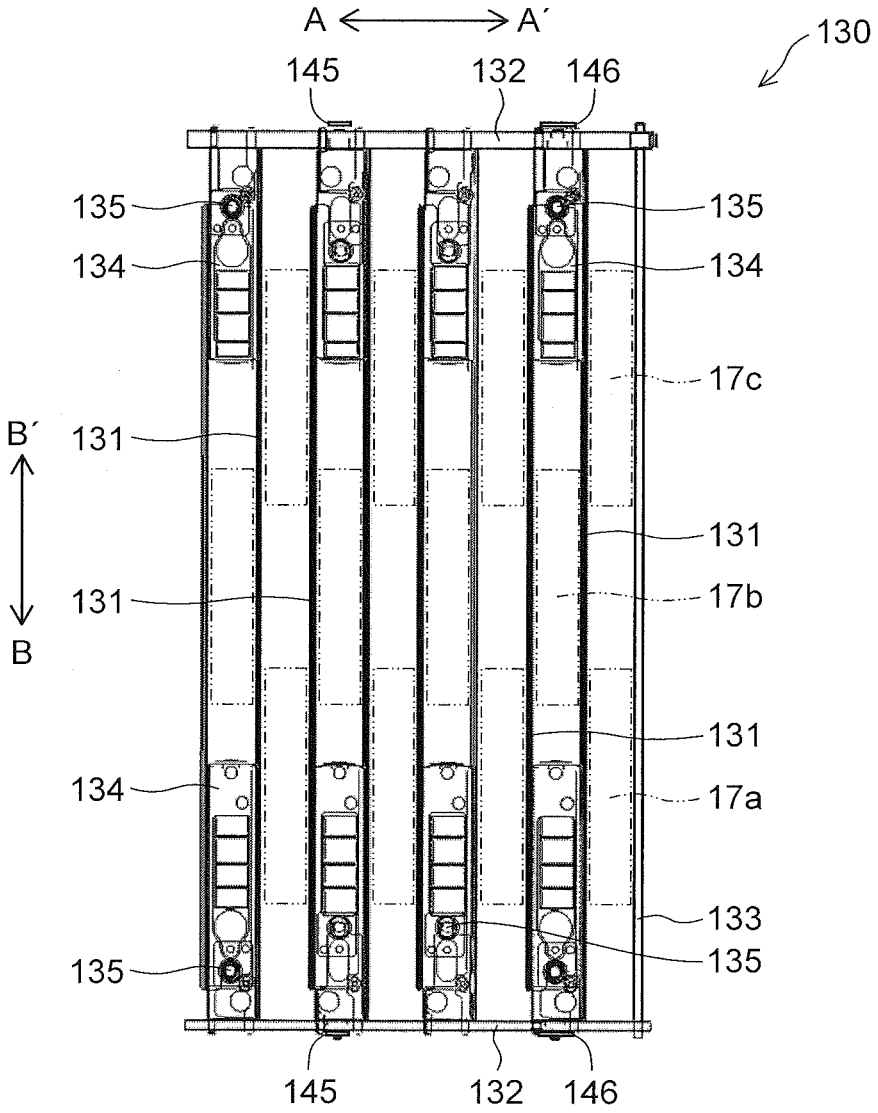
FIG. 19 is a diagram showing a structure of the entry prevention unit in the printer according to one embodiment of the present disclosure.
Figure 20:
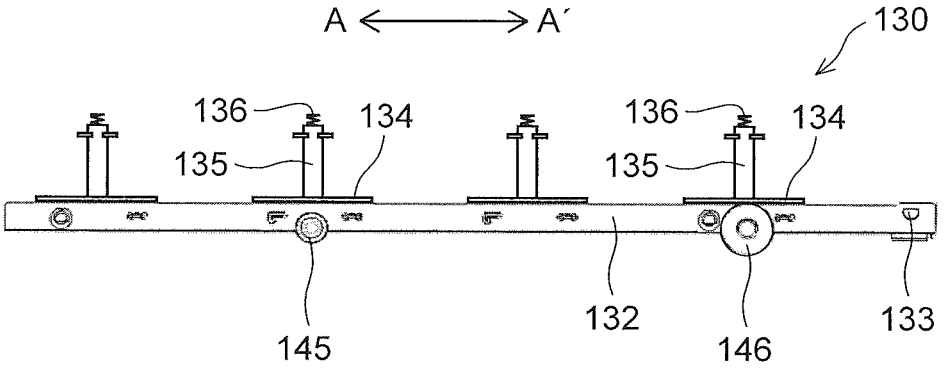
FIG. 20 is a diagram showing a structure of the entry prevention unit in the printer according to one embodiment of the present disclosure as seen from the sheet width direction.

A plurality of entry prevention members 131 are, as shown in FIG. 19, at their opposite ends in the longitudinal direction (arrow BB' direction), fixed to a pair of stays 132. The pair of stays 132 are, at their ends on one side (the right side in FIG. 19), coupled together with a coupling shaft 133. In the opposite end parts of the entry prevention members 131, a plurality of supporting metal plates 134 are fixed. The entry prevention members 131, the stays 132, the coupling shaft 133, and the supporting metal plates 134 constitute an entry prevention unit 130.

Figure 21:
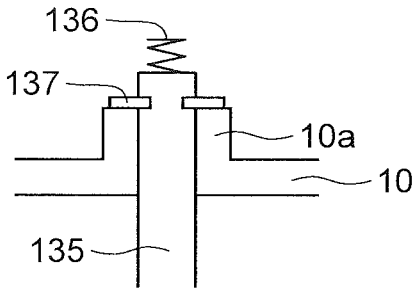
FIG. 21 is a diagram showing a structure of and around a positioning shaft portion on the entry prevention unit in the printer according to one embodiment of the present disclosure.

On the top face of each supporting metal plate 134, as shown in FIGS. 19 and. 20, there is provided a cylindrical positioning shaft portion 135, which is positioned in the horizontal direction relative to the recording heads 17*a* to 17*c*. The positioning shaft 135 is, as shown in FIG. 21, inserted in a shaft insertion portion 10*a* formed in the head housing 10 in the recording portion 9 and positioned in the horizontal direction. Inside the positioning shaft 135, there is provided a biasing member 136 comprising a compressed coil spring which constantly biases the supporting sheet metal 134 downward. Around the outer peripheral face of the positioning shaft 135, a C-ring 137 is fitted. The C-ring 137, by touching the top face of the shaft insertion portion 10*a*, prevents the entry prevention unit 130 from falling off the housing 10. In the entry prevention unit 130, there is provided a touching portion (unillustrated) which defines the entry prevention position of the entry prevention member 131 by touching a stay in the first conveying unit 5.

Figure 23:
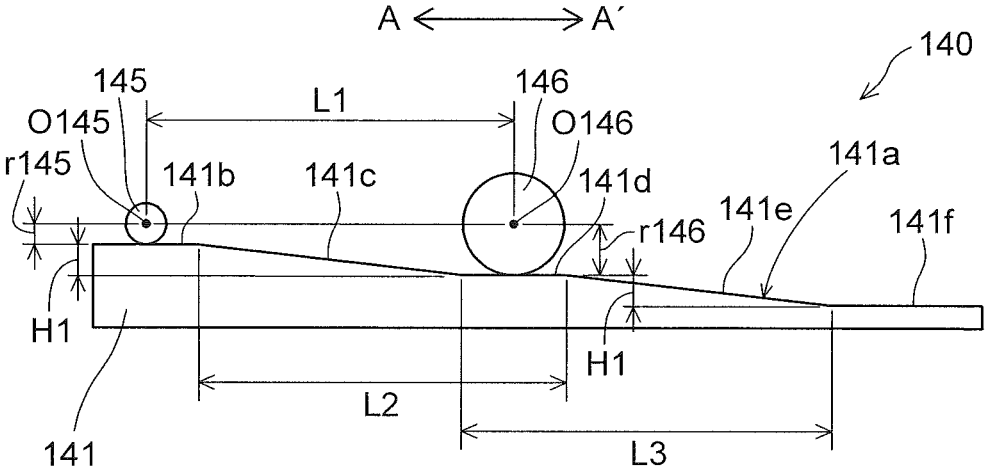
FIG. 23 is a diagram showing a structure of and around up-down movement mechanism in the printer according to one embodiment of the present disclosure.

The entry prevention unit 130 is moved in the up-down direction by an up-down movement mechanism 140 (see FIG. 23). The up-down movement mechanism 140, as the wipe unit 19 moves from the second position to the first position, moves the entry prevention unit 130 from the entry prevention position to the retracted position, and as the wipe unit 19 moves from the first position to the second position, moves the entry prevention unit 130 from the retracted position to the entry prevention position.

Figure 22:
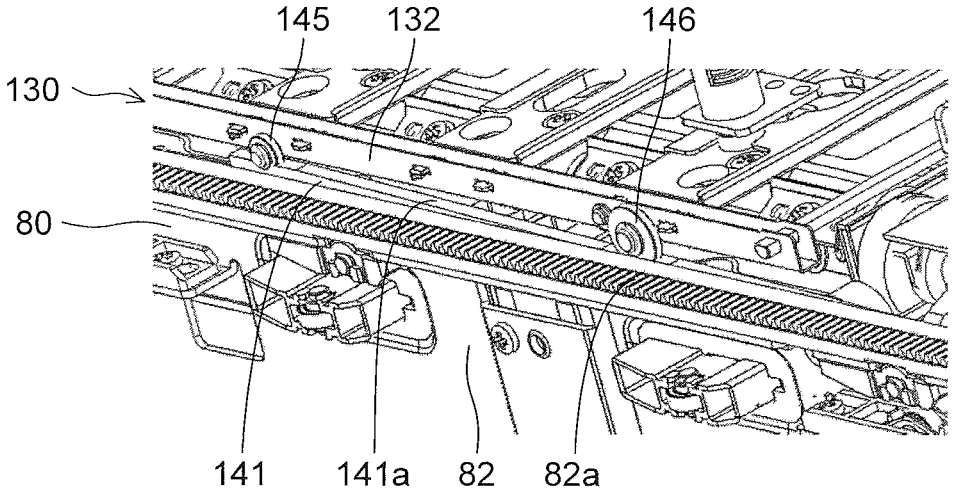
FIG. 22 is a diagram showing a structure of and around a first roller and a second roller in the printer according to one embodiment of the present disclosure.

Specifically, the up-down movement mechanism 140 includes, as shown in FIGS. 22 and 23, a pair of rail portions 141, which can reciprocate between the first position and the second position together with the wipe unit 19, and of which top faces 141*a* are inclined, and a pair of first rollers 145 and a pair of second rollers 146, which support the entry prevention unit 130 and which, while touching the top faces 141*a* of the rail portions 141, move in the up-down direction. The rail portion 141, the first roller 145, and the second roller 146 are provided one of each on either side in the sheet width direction (arrow BB' direction).

The first roller 145 and the second roller 146 are fitted to the stay 132 in the entry prevention unit 130 at its upstream and downstream sides respectively in a first direction (the arrow A' direction) pointing from the second position to the first position.

The rail portion 141 is provided inward of the rack portion 82*a* in the carriage 80 in the sheet width direction. The top face 141*a* of the rail portion 141 includes, as shown in FIG. 23, a first horizontal face 141*b*, a second horizontal face 141*d*, and a third horizontal face 141*f*, which are arranged at predetermined intervals and extend in the horizontal direction, a first inclined face 141*c*, which is arranged between the first horizontal face 141*b* and the second horizontal face 141*d* and inclined downward in the first direction (arrow A' direction), and a second inclined face 141*e*, which is arranged between the second horizontal face 141*d* and the third horizontal face 141*f* (arranged in the first direction (arrow A' direction) of the second horizontal face 141*d*) and is inclined downward in the first direction.

The first horizontal face 141*b* and the second horizontal face 141*d*, with the rail portion 141 in a state (the state in FIG. 23) arranged in the first position, touch the first roller 145 and the second roller 146 respectively, and hold the entry prevention unit 130 in a predetermined height position. The second horizontal face 141*d* and the third horizontal face 141*f*, with the rail portion 141 in a state arranged in the second position, are arranged in the same height positions as the bottom ends of the first roller 145 and the second rollers 146 respectively.

The first inclined face 141*c* and the second inclined face 141*e* are so formed as to have the same inclination angle. The first inclined face 141*c* and the second inclined face 141*e* are so formed as to have the same height H1, and the same length in the first direction.

The distance L1 between the first roller 145 and the second roller 146 in the first direction is the same as the length L2 from the upstream end of the first inclined face 141*c* in the first direction and the downstream end of the second horizontal face 141*d* in the first direction. The distance L1 between the first roller 145 and the second roller 146 in the first direction is the same as the length L3 (=L2) from the upstream end of the second horizontal face 141*d* in the first direction to the downstream end of the second inclined face 141*e* in the first direction.

The rotation center O145 of the first roller 145 and a rotation center O146 of the second roller 146 are arranged in the same height position. The radius r146 of the second roller 146 equals the sum of the radius r145 of the first roller 145 and the height H1 of the first inclined face 141*c*.

Next, recovery operation for the recording heads 17*a* to 17*c* in the printer 100 according to this embodiment will be described. The recovery operation and capping operation described below are performed by controlling, with control signals from the control portion 110 (see FIG. 1), the operation of the recording heads 17*a* to 17*c*, wipe unit 19, the unit lift mechanism 60, the unit horizontal-movement mechanism 85, the conveying lift mechanism, the driving source, and the like.

Figure 24:
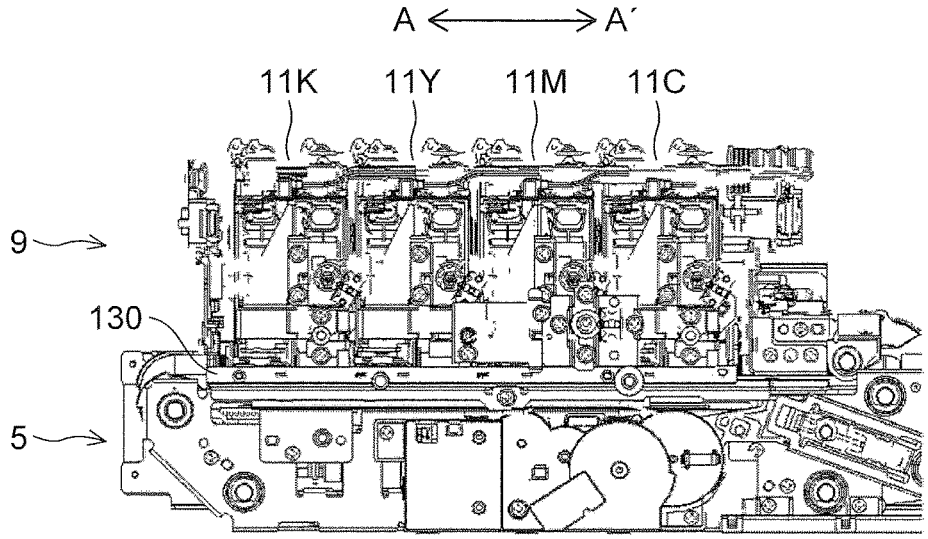
FIG. 24 is a diagram showing a structure of the recording portion and the first conveying unit in the printer according to one embodiment of the present disclosure in a state where the first conveying unit is arranged in the ascended position.

When recovery operation for the recording heads 17*a* to 17*c* is performed with the wipe unit 19, as shown in FIG. 7, the first conveying unit 5 arranged opposite the bottom face of the recording head 9 (see FIG. 1) is descended from the state in FIGS. 6 and 24. Here, the wipe unit 19 is arranged in the first height position, and the wipe unit 19 and the cap unit 50 are not coupled with each other. The entry prevention member 131 is arranged, as shown in FIG. 17, in the entry prevention position, and the lower face 131*a* projects below the ink ejection face F.

Figure 25:
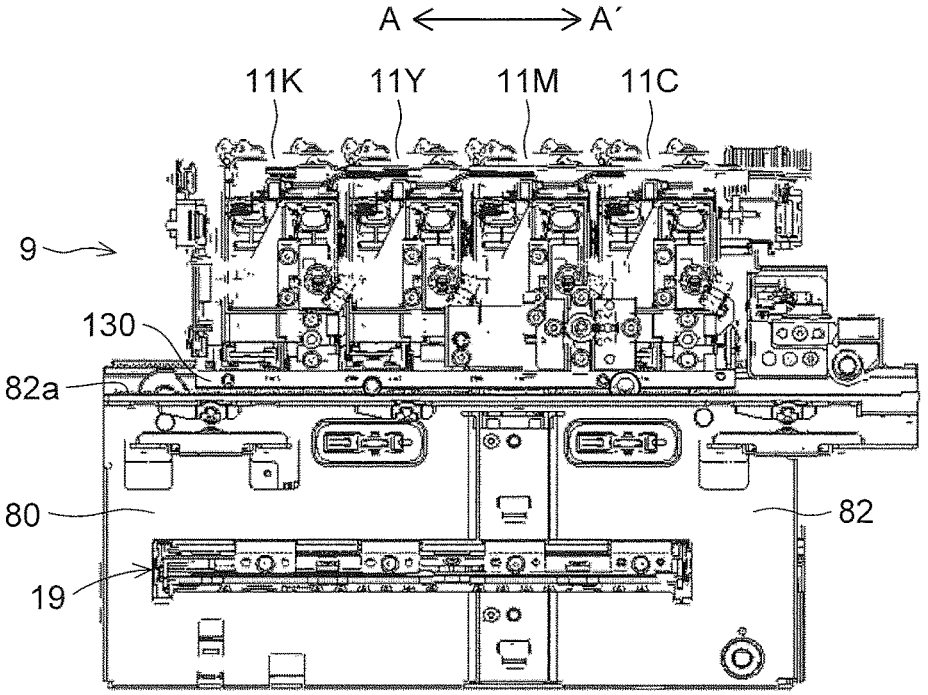
FIG. 25 is a diagram showing a structure of the recording portion and a carriage in the printer according to one embodiment of the present disclosure in a state where the carriage is arranged in the first position.

As shown in FIGS. 11 and 25, by moving the carriage 80 horizontally from the second position to the first position with the cap unit 50 left in the second position, the wipe unit 19 in the first height position is moved horizontally from the second position to the first position.

Then, the first roller 145 and the second roller 146 roll on the second horizontal face 141*d* and the third horizontal face 141*f* respectively, and then move onto the first inclined face 141*c* and the second inclined face 141*e* respectively at the same time. The first roller 145 and the second roller 146 then further roll on the first inclined face 141*c* and the second inclined face 141*e* respectively, and then move onto the first horizontal face 141*b* and the second horizontal face 141*d* respectively at the same time. With this, the entry prevention unit 130, while keeping a horizontal state, moves from the entry prevention position (position in FIG. 17) to the retracted position (position in FIG. 18). The lower face 131*a* of the entry prevention member 131 is arranged above the ink ejection face F.

The unit lift mechanism 60, as shown in FIG. 12, raises the wipe unit 19. With this, the wipers 35*a* to 35*c* in the wipe unit 19 are kept in pressed contact with the wiping start position of the ink ejection face F on the recording heads 17*a* to 17*c*.

Before wiping operation, the recording heads 17*a* to 17*c* are supplied with ink. The supplied ink is forcibly pushed (purged) out of the ejection nozzles 18 (see FIG. 2). By this purging operation, thickened ink, foreign matter, and air bubbles inside the ejection nozzles 18 are discharged. Here, the purged ink is pushed out, along the shape of the nozzle region R (see FIG. 5) in which the ejection nozzles 18 lie, to the ink ejection face F.

Then, wiping operation is performed in which the ink (purged ink) pushed out onto the ink ejection face F is wiped off. Specifically, by rotating the wiper carriage moving motor 45 forward from the state shown in FIG. 12, as shown in FIG. 13, the wiper carriage 31 moves horizontally in the arrow B direction, and the wipers 35*a* to 35*c* wipe off the ink pushed out onto the ink ejection face F on the recording heads 17*a* to 17*c*. The waste ink wiped off by the wipers 35*a* to 35*c* is collected in the ink collection tray 44 arranged inside the wipe unit 19.

Then, the unit lift mechanism 60 (see FIG. 14), as shown in FIG. 11, descends the wipe unit 19 to the first height position, and thereby separates the wipers 35*a* to 35*c* downward from the ejection face F on the recording heads 17*a* to 17*c*. Then, the wiper carriage 31 is moved in the direction (arrow B' direction) opposite to the wiping direction, so that the wipe unit 19 is restored to the original state.

Then, the carriage 80 and the wipe unit 19 arranged in the first position are moved horizontally from the first position to the second position. With this, the wipe unit 19 is arranged below the cap unit 50.

Then, the first roller 145 and the second roller 146 roll on the first horizontal face 141*b* and the second horizontal face 141*d* respectively, and then move onto the first inclined face 141*c* and the second inclined face 141*e* respectively at the same time. The first roller 145 and the second roller 146 then further roll on the first inclined face 141*c* and the second inclined face 141*e* respectively, and then move onto the second horizontal face 141*d* and the third horizontal face 141*f* respectively at the same time. With this, the entry prevention unit 130, while keeping a horizontal state, moves from the retracted position to the entry prevention position. The lower face 131*a* of the entry prevention member 131 is arranged so as to project below the ink ejection face F.

Recovery operation for the recording heads 17*a* to 17*c* is thus finished.

Next, operation (capping operation) in which the cap unit 50 is attached to the recording heads 17*a* to 17*c* in the printer 100 according to this embodiment will be described.

When the recording heads 17*a* to 17*c* are capped with the cap unit 50, as shown in FIG. 7, the first conveying unit 5 arranged opposite the bottom face of the recording portion 9 (see FIG. 1) is descended from the state in FIGS. 6 and 24. Here, the wipe unit 19 is arranged in the first height position, and the wipe unit 19 and the cap unit 50 are not coupled with each other. The entry prevention member 131 is arranged, as shown in FIG. 17, in the entry prevention position, and the lower face 131*a* projects below the ink ejection face F.

The unit lift mechanism 60 (see FIG. 14) raises the wipe unit 19 from the first height position to the second height position. With this, as shown in FIG. 16, the coupling pins 42 are inserted into the coupling holes 52*a*, and thus the wipe unit 19 and the cap unit 50 are coupled with each other.

Thereafter, as shown in FIG. 8, as the carriage 80 is moved horizontally from the second position to the first position, the cap unit 50, which is in a state coupled with the top face of the wipe unit 19, moves horizontally from the second position to the first position.

Here, the first roller 145 and the second roller 146 move on the top face 141*a* of the rail portion 141 in the same way as during recovery operation as mentioned above. With this, the entry prevention unit 130, while keeping a horizontal state, moves from the entry prevention position to the retracted position, and the lower face 131*a* of the entry prevention member 131 is arranged above the ink ejection face F.

The unit lift mechanism 60, as shown in FIG. 9, raises the wipe unit 19 and the cap unit 50. When the cap portion 53 in the cap unit 50 makes close contact with the ink ejecting face F on the recording heads 17*a* to 17*c*, the rotation of the wind-up drive motor 64 (see FIG. 14) is stopped, and thus the capping of the recording heads 17*a* to 17*c* by the cap unit 50 is completed.

When the recording heads 17*a* to 17*c* are uncapped (when proceeding to printing or recovery operation), operation reverse to that described above is performed, thus it will be described briefly.

In the first position, the unit lift mechanism 60 descends the wipe unit 19 and the cap unit 50 until the wipe unit 19 reaches the second height position. With this, the cap portion 53 is separated from the ink ejection face F. Then, the carriage 80 is moved horizontally from the first position to the second position, and thus the wipe unit 19 and the cap unit 50, which are in a state coupled with each other, are arranged in the second position.

Here, the first roller 145 and the second roller 146 move on the top face 141*a* of the rail portion 141 in the same way as during recovery operation as mentioned above. With this, the entry prevention unit 130, while keeping a horizontal state, moves from the retracted position to the entry prevention position, and the lower face 131*a* of the entry prevention member 131 is arranged so as to project below the ink ejection face F.

Thereafter, in the second position, the unit lift mechanism 60 descends the wipe unit 19 from the second height position to the first height position. With this, the coupling pins 42 are pulled out of the coupling holes 52*a*, and thus the wipe unit 19 and the cap unit 50 are decoupled from each other.

According to this embodiment, as mentioned above, there is provided, between the recording heads 17*a* and 17*c* and the recording head 17*b* in the sheet conveying direction, the entry prevention member 131 for preventing sheet P from entering the gaps between the recording heads 17*a* and 17*c* and the recording head 17*b*. The entry prevention member 131 is, during printing operation, arranged in the entry prevention position, where its lower face 131*a* is flush with the ink ejection face F or projects below the ink ejection face F. With this, it is possible to prevent the conveyed sheet P from entering the gaps between the recording heads 17*a* and 17*c* and the recording head 17*b*, and thereby to suppress the occurrence of sheet jams.

The entry prevention member 131 is, during wiping operation by the wipe unit 19, arranged in the retracted position where the lower face 131*a* is retracted above the ink ejection face F. With this, it is possible to prevent the wipers 35*a* to 35*c* from touching the entry prevention member 131 during wiping operation, and thereby to suppress occurrence of an unwiped area resulting from the wipers 35*a* to 35*c* being distorted by the entry prevention member 131. It is also possible to prevent ink or the like from attaching to the entry prevention member 131.

As mentioned above, there is provided the up-down movement mechanism 140, which, in coordination with the movement of the wipe unit 19 between the first position and the second position, moves the entry prevention member 131 between the retracted position and the entry prevention position. With this, it is possible, without providing a separate driving source for moving the entry prevention member 131 in the up-down direction, to arrange the entry prevention member 131 in the entry prevention position during printing operation, and to arrange the entry prevention member 131 in the retracted position during wiping operation.

As mentioned above, the up-down movement mechanism 140 includes the rail portions 141, which can reciprocate between the first position and the second position together with the wipe unit 19, and of which top faces 141*a* are inclined, and the first rollers 145 and the second rollers 146, which support the entry prevention member 131 and which, while touching the top faces 141*a* of the rail portions 141, move in the up-down direction. With this, in coordination with the movement of the wipe unit 19 between the first position and the second position, the entry prevention member 131 can be easily moved between the retracted position and the entry prevention position.

As mentioned above, the distance L1 between the first roller 145 and the second roller 146 in the first direction is the same as the length L2 from the upstream end of the first inclined face 141*c* in the first direction and the downstream end of the second horizontal face 141*d* in the first direction. With this, the entry prevention unit 130 can be easily moved in the up-down direction while keeping a horizontal state.

As mentioned above, the radius r146 of the second roller 146 equals the sum of the radius 145 of the first roller 145 and the height H1 of the first inclined face 141*c*. With this, the entry prevention unit 130 can be moved in the up-down direction more easily while keeping a horizontal state.

As mentioned above, the upstream end 131*b* of the lower face 131*a* of the entry prevention member 131 is, with the entry prevention member 131 in a state arranged in the entry prevention position, arranged above the ink ejection face F. With this, it is possible to easily prevent the conveyed sheet P from getting caught on the entry prevention member 131.

The embodiments disclosed above should be understood to be in every aspect illustrative and not restrictive. The scope of the present disclosure is defined not by the description of the embodiments given above but by the appended claims, and should be understood to encompass any modifications made in the sense and scope equivalent to those of the claims.

For example, although the above embodiments deal with an example where the third horizontal face 141*f* is provided on the downstream side, in the first direction (arrow A' direction), of the second inclined face 141*e* in the rail portion 141, the third horizontal face 141*f* does not necessarily need to be provided. In that case, the second inclined face 141*e* can be formed to extend further to the downstream side in the first direction.

For another example, although the above embodiments deal with an example provided with the up-down movement mechanism 140 which moves the entry prevention unit 130 in coordination with the movement of the wipe unit 19, this is not meant to limit the present disclosure. For example, the wipe unit 19 can be moved between the first position and the second position using a driving source such as a motor or a solenoid.

What is claimed is:

1. An ink-jet recording apparatus, comprising:

a plurality of recording heads having an ink ejection face in which ejection nozzles for ejecting ink onto a recording medium are open;

a wipe unit reciprocatable between a first position right below the recording heads and a second position horizontally retracted from the first position, the wipe unit having a wiper for performing wiping operation whereby the ink ejection face is wiped in a predetermined direction in the first position; and an entry prevention member arranged between the recording heads in a recording medium conveying direction to prevent the recording medium from entering a gap between the recording heads, wherein the entry prevention member is configured to be movable in an up-down direction, the entry prevention member being arranged in an entry prevention position where a lower face thereof is flush with the ink ejection face or projects below the ink ejection face during printing operation, the entry prevention member being arranged in a retracted position where the lower face is retracted above the ink ejection face during wiping operation by the wipe unit.

2. The ink-jet recording apparatus according to claim 1, further comprising:

an up-down movement mechanism for moving the entry prevention member between the retracted position and the entry prevention position in coordination with movement of the wipe unit between the first position and the second position.

3. The ink-jet recording apparatus according to claim 2, wherein the up-down movement mechanism includes:

a rail portion reciprocatable between the first position and the second position together with the wipe unit and having an inclined top face; and a roller supporting the entry prevention member and movable in the up-down direction while touching the top face of the rail portion.

4. The ink-jet recording apparatus according to claim 3, further comprising:

an entry prevention unit including a plurality of the entry prevention members, wherein the roller includes a first roller and a second roller respectively arranged on an upstream side and a downstream side of the entry prevention unit in a first direction pointing from the second position to the first position, the top face of the rail portion includes:

a first horizontal face and a second horizontal face which touch the first roller and the second roller respectively in a state where the rail portion is arranged in the first position and which extend in a horizontal direction;

a first inclined face arranged between the first horizontal face and the second horizontal face and inclined downward in the first direction; and a second inclined face arranged on the downstream side of the second horizontal face in the first direction and inclined downward to the first direction at a same inclination angle as the first inclined face, and a distance between the first roller and the second roller in the first direction is same as a length from an upstream end of the first inclined face in the first direction to a downstream end of the second horizontal face in the first direction.

5. The ink-jet recording apparatus according to claim 4, wherein a rotation center of the first roller and a rotation center of the second roller are arranged in a same height position, a radius of the second roller equals a sum of a radius of the first roller and a height of the first inclined face.

6. The ink-jet recording apparatus according to claim 1, wherein the lower face of the entry prevention member is formed to be inclined downward from upstream to downstream in the recording medium conveying direction, and an upstream end of the lower face of the entry prevention member in the recording medium conveying direction is arranged above the ink ejection face in a state where the entry prevention member is arranged in the entry prevention position.

* * * * *